US005145441A

United States Patent [19]

Hsun

[11] Patent Number: 5,145,441

[45] Date of Patent: Sep. 8, 1992

[54] CONSTRUCTIONAL KIT

[76] Inventor: Yan J. Hsun, 58, Ma Yuan West St., Taichung, Taiwan

[21] Appl. No.: 753,614

[22] Filed: Aug. 30, 1991

[51] Int. Cl.[5] ..... A63H 33/08

[52] U.S. Cl. ..... 446/126; 446/124; 52/648

[58] Field of Search ..... 446/124, 107, 108, 126, 446/116, 125, 105, 85, 110, 128, 120, 121; 52/648; D21/108; 434/211, 278

[56] References Cited

U.S. PATENT DOCUMENTS

| | | | |
|---|---|---|---|
| 2,649,803 | 8/1953 | Andre | 446/120 X |
| 2,986,241 | 5/1961 | Fuller | 446/126 X |
| 4,302,900 | 12/1981 | Rayner | 446/126 X |
| 4,334,868 | 6/1982 | Levinrad | 446/105 X |
| 5,009,625 | 4/1991 | Longuet-Higgins | 446/85 X |

FOREIGN PATENT DOCUMENTS

| | | | |
|---|---|---|---|
| 45677 | 5/1966 | German Democratic Rep. | 446/124 |
| 996443 | 6/1965 | United Kingdom | 446/126 |

*Primary Examiner*—Mickey Yu

[57] ABSTRACT

A constructional kit including a number of members each having a hexagonal cross section, each of the members including two ends each having a hexagonal pyramid shape including six tapered surfaces, a stub and a recess being formed alternatively on the tapered surfaces of each of the members, each of the stubs being engageable with either of the recesses so that the members can be assembled in a spatial configuration.

2 Claims, 5 Drawing Sheets

CONSTRUCTIONAL KIT

BACKGROUND OF THE INVENTION (a) Field of the Invention

The present invention relates to a constructional kit.

(b) Description of the Prior Art

Typical constructional kit, particularly toy building block, includes a plurality of blocks and/or bars which can be assembled together in various shapes. However, generally, the constructional kit can not be assembled in a spatial configuration.

The present invention has arisen to mitigate and/or obviate the afore-described disadvantages of the conventional constructional kits.

SUMMARY OF THE INVENTION

The primary objective of the present invention is to provide a constructional kit which can be assembled to a spatial configuration.

In accordance with one aspect of the present invention, there is provided a constructional kit including a number of members each having a hexagonal cross section, each of the members including two ends each having a hexagonal pyramid shape including six tapered surfaces, a stub and a recess being formed alternatively on the tapered surfaces of each of the members, each of the stubs being engageable with either of the recesses so that the members can be assembled in a spatial configuration.

Further objectives and advantages of the present invention will become apparent from a careful reading of the detailed description provided hereinbelow, with appropriate reference to the accompanying drawings.

BRIEF DESCRIPTION OF THE DRAWINGS

FIGS. 5-1 to 5-5 are schematic views illustrating five examples embodying the present invention.

DETAILED DESCRIPTION OF THE INVENTION

Figure 3:
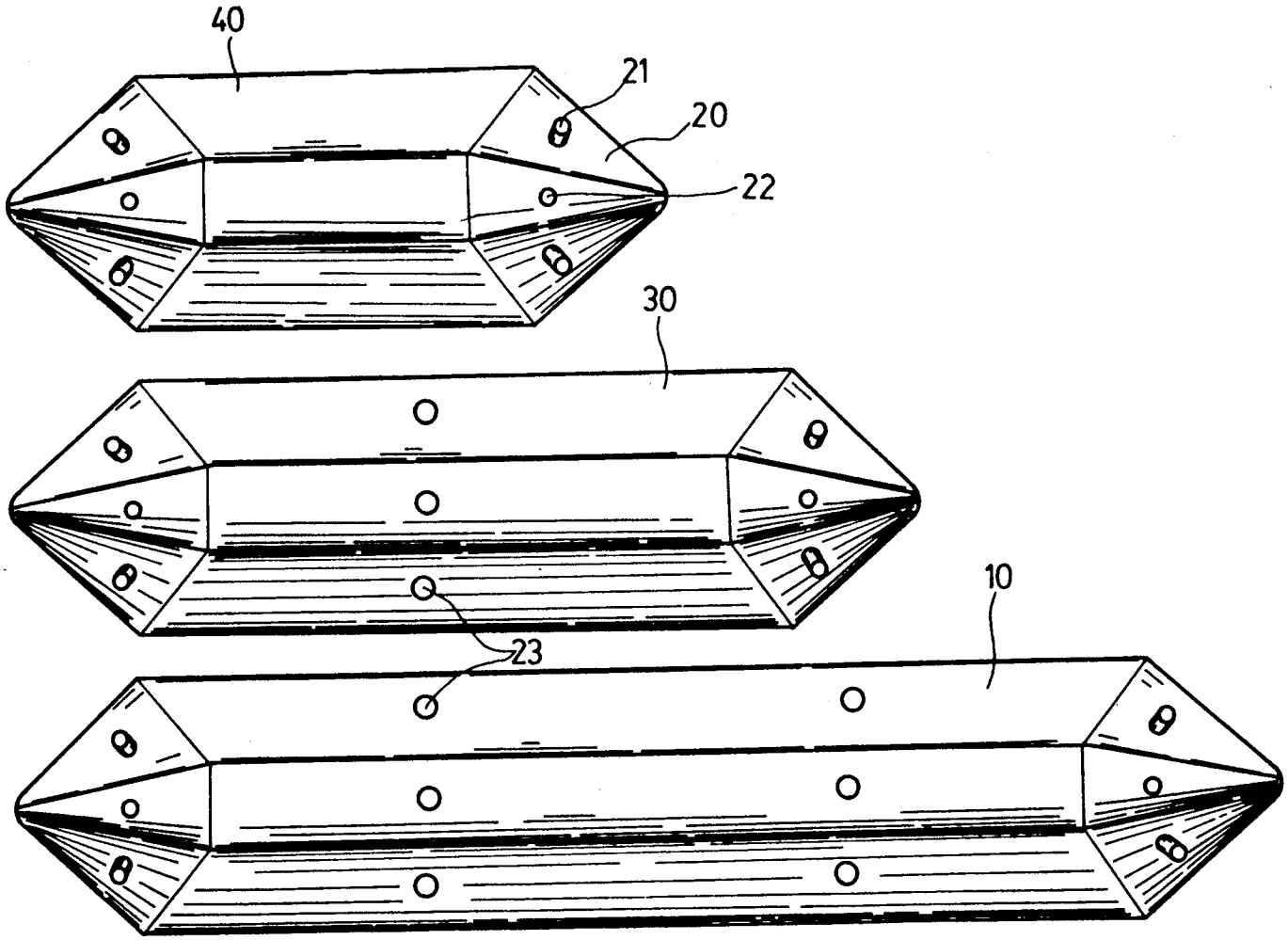
FIG. 3 is a plane view illustrating three members of different lengths of the constructional kit.

Referring to the drawings and initially to FIGS. 1 to 4, a constructional kit in accordance with the present invention comprises generally a plurality of members 10, 30, 40 of different lengths as shown in FIG. 3. Each of the members 10, 30, 40 has a substantially hexagonal cross section including six side surfaces and includes two ends each having a hexagonal pyramid shape including six tapered surfaces 20. The preferable inclinations of the tapered surfaces 20 are 30°, 45° and 60°. A stub 21 and a recess 22 are formed alternatively on the tapered surfaces 20 of the members 10, 30, 40.

For the longer member 10 as shown in FIG. 3, two depressions 23 are formed in each of the side surfaces thereof. For the member 30 of shorter length than that of the member 10, only one depression 23 is formed in each of the side surfaces thereof. No depressions 23 are formed in the side surfaces of the shortest member 40. The stub 21 is engageable with either of the recesses 22 and either of the depressions 23.

Figure 1:
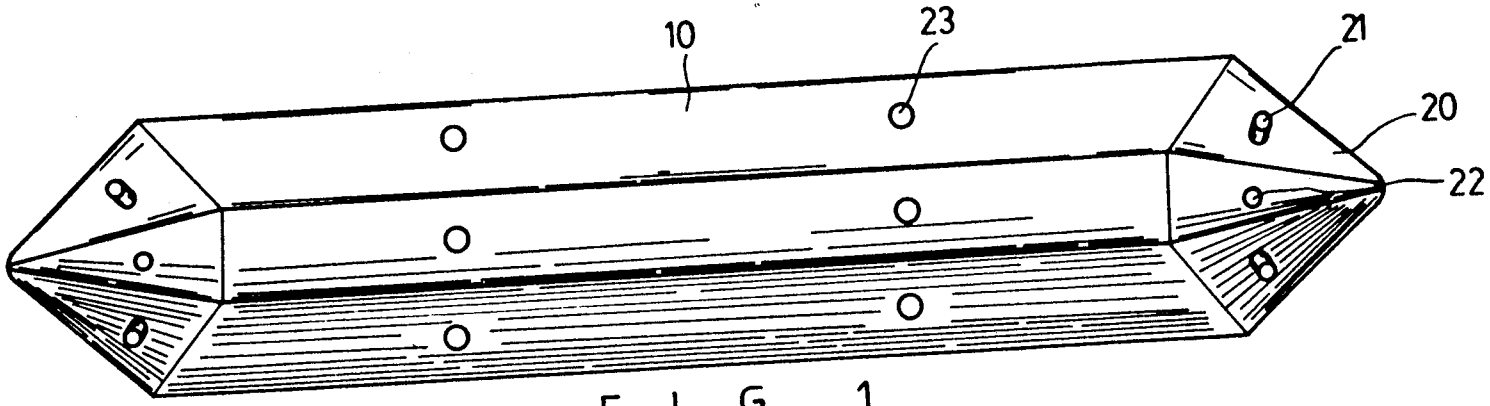
FIG. 1 is a plane view of a member of the constructional kit in accordance with the present invention.
Figure 2:
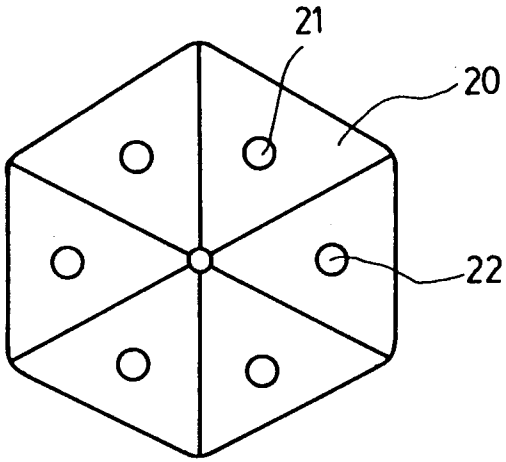
FIG. 2 is an end view of the member as shown in FIG. 1.
Figures 1, 5:
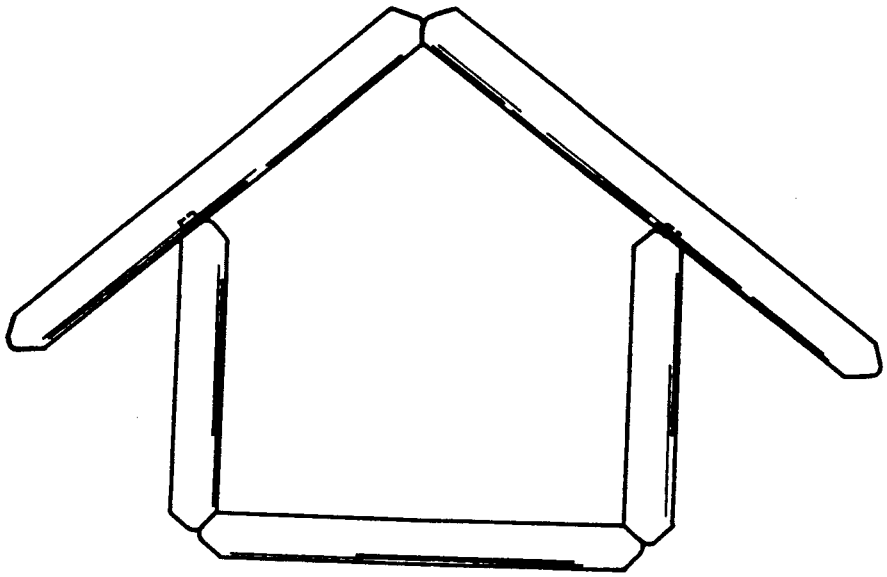
Figure 4:
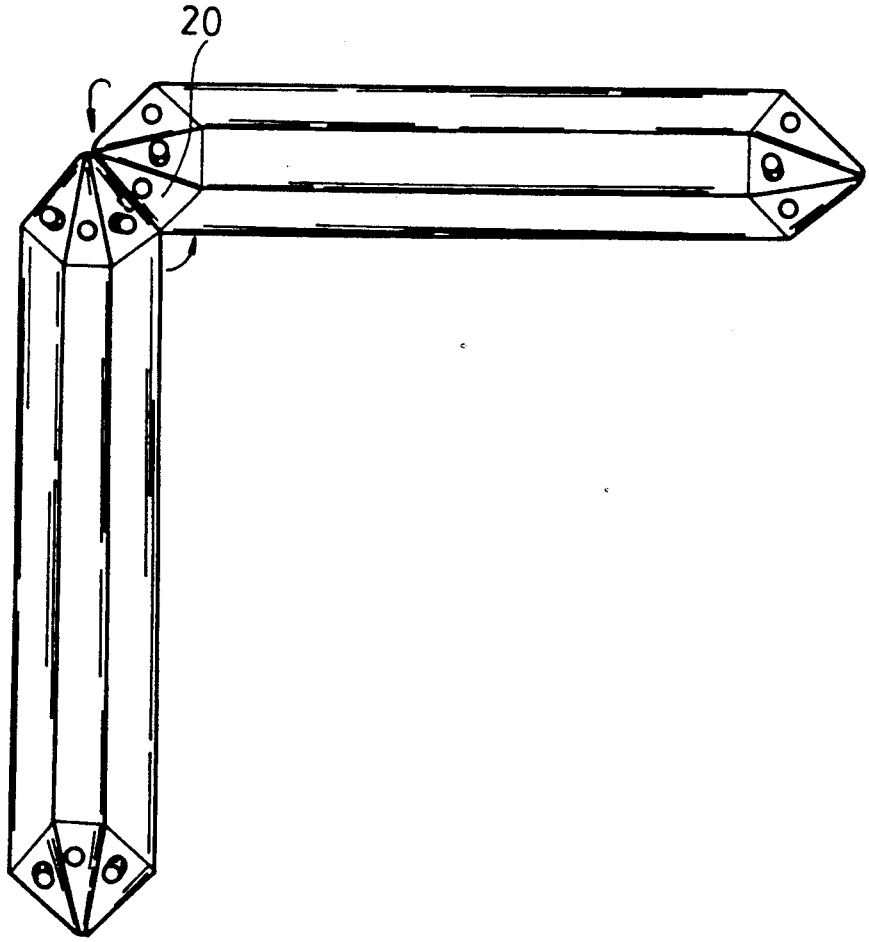
FIG. 4 is a schematic view illustrating the assembling operation of the members.
Figures 2, 5:
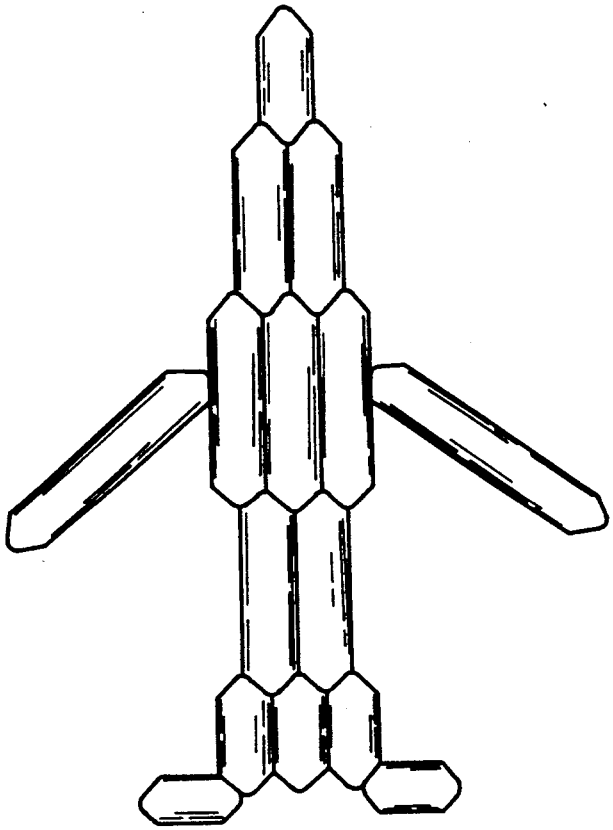
Figures 3, 5:
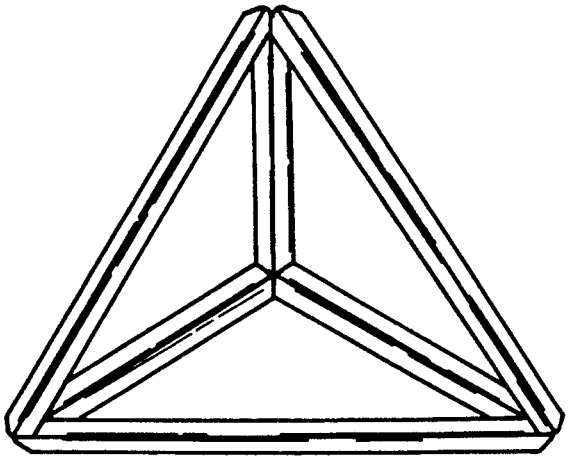
Figures 4, 5:
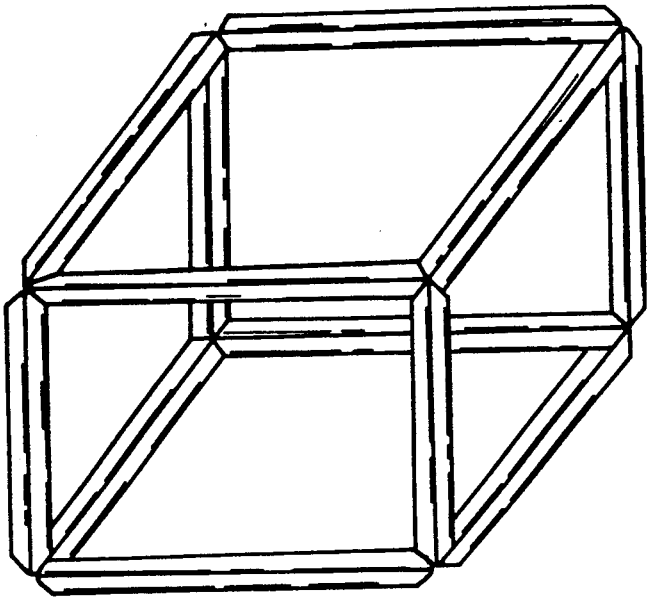
Figure 5:
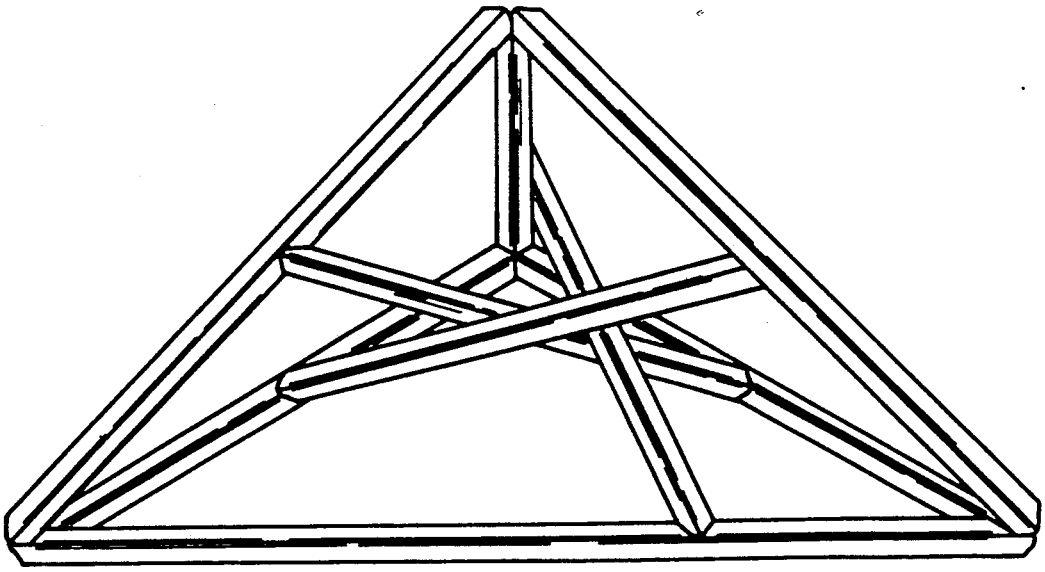

As shown in FIGS. 5-1 to 5-5, illustrated are five examples of the members 10, 30, 40 when assembled. The members 10, 30, 40 can be assembled in a spatial configuration as shown in FIGS. 5-3 to 5-5.

Accordingly, the constructional kit in accordance with the present invention can be assembled in a spatial configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A constructional kit comprising a plurality of members each being an elongated body and having a substantially uniform cross section, each of said members including two ends each having a conical and tapered shape, at least one stub and at least one recess being formed on each of said ends of each of said members, said stubs being engageable with said recesses so that said members can be assembled in a spatial configuration.

2. A constructional kit according to claim 1, wherein said cross section of each of said members is substantially hexagonal defining six rectangular side surfaces; said constructional kit includes at least two members of different lengths, at least one depression is formed in each of said side surfaces of each of said members, said stubs are engageable with said depressions.

* * * * *